US007299508B2

(12) United States Patent
Li

(10) Patent No.: US 7,299,508 B2
(45) Date of Patent: Nov. 27, 2007

(54) PRESSURIZED FLUSH SYSTEM

(76) Inventor: Feiyu Li, First Floor, #43 Huli Main Road, Xiamen (CN) 361006

( * ) Notice: Subject to any disclaimer, the term of this patent is extended or adjusted under 35 U.S.C. 154(b) by 413 days.

(21) Appl. No.: 10/985,260

(22) Filed: Nov. 10, 2004

(65) Prior Publication Data

US 2005/0150038 A1 Jul. 14, 2005

Related U.S. Application Data

(60) Provisional application No. 60/535,738, filed on Jan. 8, 2004.

(51) Int. Cl.
*E03D 3/10* (2006.01)

(52) U.S. Cl. ..... 4/354

(58) Field of Classification Search ..... 4/354–362
See application file for complete search history.

(56) References Cited

U.S. PATENT DOCUMENTS 3,605,125 A 9/1971 Gibbs et al.
3,817,489 A 6/1974 Caron et al.
3,820,754 A 6/1974 Caron et al.
4,233,698 A 11/1980 Martin
5,027,444 A * 7/1991 Tsals ..... 4/226.1
5,046,201 A 9/1991 Steinhardt et al.
5,652,969 A * 8/1997 Taylor ..... 4/359
5,802,628 A 9/1998 Spoeth et al.
6,029,287 A 2/2000 Ge et al.
RE37,921 E 12/2002 Martin et al.
6,550,076 B1 * 4/2003 Fish ..... 4/359
2005/0251904 A1 * 11/2005 Gubeli et al. ..... 4/354

* cited by examiner

*Primary Examiner*—Charles E. Phillips
(74) *Attorney, Agent, or Firm*—Walter A. Hackler

(57) ABSTRACT

A pressurized flush system includes a pressure water vessel having an inlet and an outlet. An infill valve, an open valve, and a flush valve are provided with the flush valve disposed within the pressure vessel and in fluid communication with the infill valve and the open valve. The flush valve includes a hollow valve body and cooperating pistons controlling water discharge from the water vessel outlet. The cooperating pistons are disposed within the hollow valve body.

12 Claims, 6 Drawing Sheets

PRESSURIZED FLUSH SYSTEM

The present application is a continuation of U.S. Provisional Patent Application Ser. No. 60/535,738 filed Jan. 8, 2004. This referenced patent application is to be incorporated into the present application in its entirety by this specific reference thereto.

The present invention is generally related to pressurized flushed systems for toilets and is more specifically directed to a flushing system that maximizes the efficiency of effluent transport within a pressure baffle and discharge to a toilet bowl.

Water conservation is an environmental consideration and has resulted in strict controls being placed on domestic water usages.

Pressurized flushed systems have been developed to conserve water use.

Often prior art systems do not efficiently discharge water and often require a user to hold open a valve in order that water is fully discharged. Accordingly, a user is required to cooperate with time delay operation in order to efficiently discharge the water from the pressure tank.

In addition, any prior art devices have no air-in provision. This does not provide efficient water filling into the pressure.

The present invention overcomes the drawbacks of the prior art.

SUMMARY OF THE INVENTION

The present invention provides an improved structure in which flush performance is not influenced by a users' habits, while providing for simple structure to accomplish this aim.

A pressurized flush system in accordance with the present invention generally includes a pressure water vessel, having an inlet and an outlet, an infill valve, an open valve, and a flush valve disposed within said pressure water vessel and in fluid communication with said infill valve and said open valve. More particularly, the flush valve includes a hollow valve body and cooperating pistons for controlling water discharge from the water vessel outlet. The cooperating pistons are disposed within the hollow valve body.

Further, the system flush valve includes a partition disposed within the valve body, with the partition having a hole therethrough and the cooperating pistons include a big piston disposed below the partition and a small piston disposed above the partition within an upper cylinder sleeve, the small piston having a bottom engaging the partition hole.

Accordingly, the big piston, small piston, upper cylinder sleeve, and partition divide the valve body into a lower cavity, an upper cavity and a normal pressure cavity.

A normal pressure opening may be disposed in the normal pressure cavity and the small piston may include an opening in the bottom thereof communicating with said upper cavity.

More particularly, the open valve includes an open valve body with an inlet connected with an outlet of the flush valve, the open valve body includes a water release hole connected to the normal pressure cavity, and the open valve includes a spring loaded handle having a side covering and sealing the open valve body inlet.

The system further includes a combination valve disposed between the infill valve and the water vessel inlet, with the combination valve including a pressure-controlled valve disposed in a manner shutting of the vessel inlet when the water vessel is discharging water and an air-in device disposed in a manner filling air into the water vessel when water is filled into the water vessel.

Still more particularly in accordance with the present invention the pressure-controlled valve includes an infill cavity, a water pressure cavity, an infill piston and a pressure-controlled spring, the infill cavity being connected respectively with the inlet duct and the outlet duct of the combination valve; the water pressure cavity being connected with the outlet of the combination valve.

In addition, the system may include a through hole partition disposed between the infill cavity and the water pressure cavity and the infill piston may be disposed inside the water pressure cavity on which is set a piston rod, which goes through the partition through hole and reaches into an outlet duct with the push of the pressure-controlled spring with and end forming a seal with the outlet duct.

Further, a spout may be disposed inside the outlet duct of the combination valve with the spout having a necked bottom and an air-in ball valve is disposed in a ring shaped cavity between the outlet duct and the spout, the ball valve forming an air-in device with the spout.

More specifically, the system includes a water release tube disposed inside the flush valve and located in a middle of the upper cylinder sleeve and extending to the water vessel outlet, a check valve being disposed inside the water release tube.

Still more particularly, the system includes an outer flank surrounding the vessel outlet and defining an annulus outlet therebetween, the flank including a normal pressure water release hole and a ring shaped check valve is disposed in said annulus outlet below the normal pressure water release hole.

The system may also include an anti-siphon ball valve disposed in a combination valve inlet duct, the anti-siphon ball valve opening when the pressure in a water supply line is equal or lower than atmospheric pressure.

Finally, the system may also include a check ball valve disposed in a channel between the connecting valve inlet duct and a combination valve outlet duct, the check ball valve shutting off when pressure in the combination valve outlet duct is higher than pressure in the combination valve inlet duct.

The flush system in accordance with the present invention has the following advantages:

1. The structure of the flush valve facilitates effective operation.

As the present invention has one big and one small piston in the flush valve, and the flush valve body is divided into three cavities; the upper cavity, the lower cavity, and the normal pressure cavity, when to flush the toilet, it is only needed to discharge a small portion of water in the upper cavity to open the big piston, and water in the lower cavity can be temporarily stored in the normal pressure cavity. As pressurized water that need be discharged from the flush valve is much less than that of the prior art, the open valve is not required to be complicated. Generally speaking, only a simple restoring device is needed for the open valve, with which the pressurized water in the upper cavity can be fully discharged with a short press, and the pressurized water in the lower cavity can be temporarily stored in the normal pressure cavity until the flush is completed. And thus the structure of the open valve is much simplified, and the water flush volume as well as the flush performance will not be influenced by different press habits of users.

2. An air-in device is added at the pressure-controlled switch, performing a combination valve, which improves the flush performance. The present invention utilizes the high-speeded water flow during the initial period, making it carry air when filling and add air into the pressure water vessel, and thus a better flush performance can be attained.

3. The combination valve mentioned in the present invention is a valve with multiple functions, including a pressure-controlled valve, an air-in device, an anti-siphon device, and a check valve.

Among these, the pressure-controlled valve can attain a purpose of not to infill when flushing, and can make the flush volume more steady, preventing leakage when the flush valve cannot close due to the low pressure in the water supply system; the air-in device can fill some air into the pressure water vessel when water is filling; the anti-siphon device and the check valve device can prevent backflow from the pressure water vessel into the water supply system and making it polluted.

4. In the flush valve of the present invention is set a water release tube, which, during the refill stage, can release water stored in the normal pressure cavity when flushing the toilet bowl. There is also a check valve in the water release tube, which can prevent backflow of wastewater from the toilet bowl into the normal pressure cavity caused by the resistance from the toilet bowl when flushing.

BRIEF DESCRIPTION OF THE DRAWINGS

The advantages and features of the present invention will be better understood by the following description when considered in conjunction with the accompanying drawings in which.

DETAILED DESCRIPTION

Figure 6:
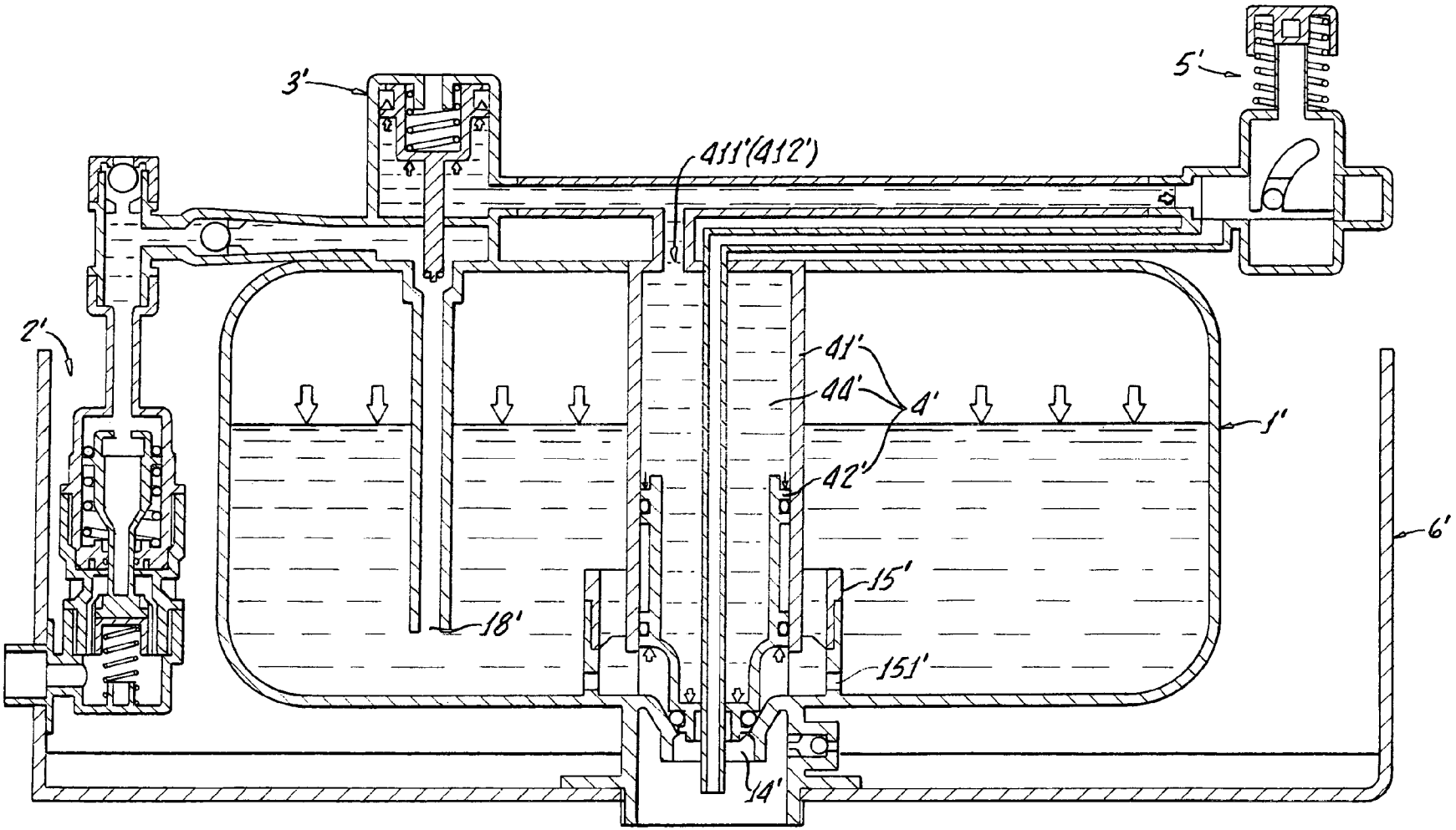
FIG. 6 is a diagrammatical sketch of a prior art pressurized flush system.

With reference to FIG. 6, there is shown a prior art pressurized flush system used in toilets that has been widely accepted due to its saving more water than a conventional normal pressure flush system.

As shown in FIG. 6, this pressurized flush system comprises a pressure water vessel 1' fixed in a ceramic tank 6', an infill valve 2', a flush valve 4', and an open valve 5' which can discharge the pressurized water from the flush valve 4'. The flush valve 4' is fixed through the pressure water vessel 1' and seals it. Above the outlet 14' in the pressure water vessel 1' is set a refill bar 15', in the bottom of which is set at least one refill orifice 151.

The flush valve 4' mainly includes a hollow valve body 41' fixed in the pressure water vessel 1', and a flush piston 42' which is set in the valve body 41' and can hermetically slide in it. The bottom of the flush piston 42' can seal the outlet 14' of the pressure water vessel 1', and on the valve body 41' are set an inlet 411' and an outlet 412'. Besides, between the infill valve 2' and the inlet 18' of the pressure water vessel 1' is set a pressure-controlled switch 3' which closes the inlet 18' when water is being discharged from the pressure water vessel 1'. The inlet 411' of flush valve 4' is connected with the pressure-controlled switch 3', and the outlet 412' is connected with the open valve 5'.

However, the prior art described has disadvantages as follows:

1. The structure of the flush valve 4' is too simple, and especially, the flush valve cavity 44' above the flush piston 42' is too big, and thus the water that need be discharge is too much, and all the water will go through the open valve 5', which requires the user delay some time when opening the open valve 5', otherwise, water in the flush valve cavity 44' cannot be fully discharged, making the flush piston close too early, which influences the flush performance for the toilet. If user cooperation for providing a time delay is not realistic, then the open valve 5' must have a built in time delay function, which will make the open valve 5' overly complicated.

2. There is no air-in device. Although in the above patent application the pressure water vessel 1' is under normal pressure during the terminal phase of flushing and the refill process, air form the outside can fill into the pressure water vessel 1' during this period, and a wanted flush performance can be reached even though there is no air-in device, however, during the initial phase of water filling into the pressure water vessel, the energy of high-speeded water flow is not utilized but wasted. If to add an air-in device here, more energy can be stored in the pressure water vessel 1', and the flush performance can be better.

Figure 1:
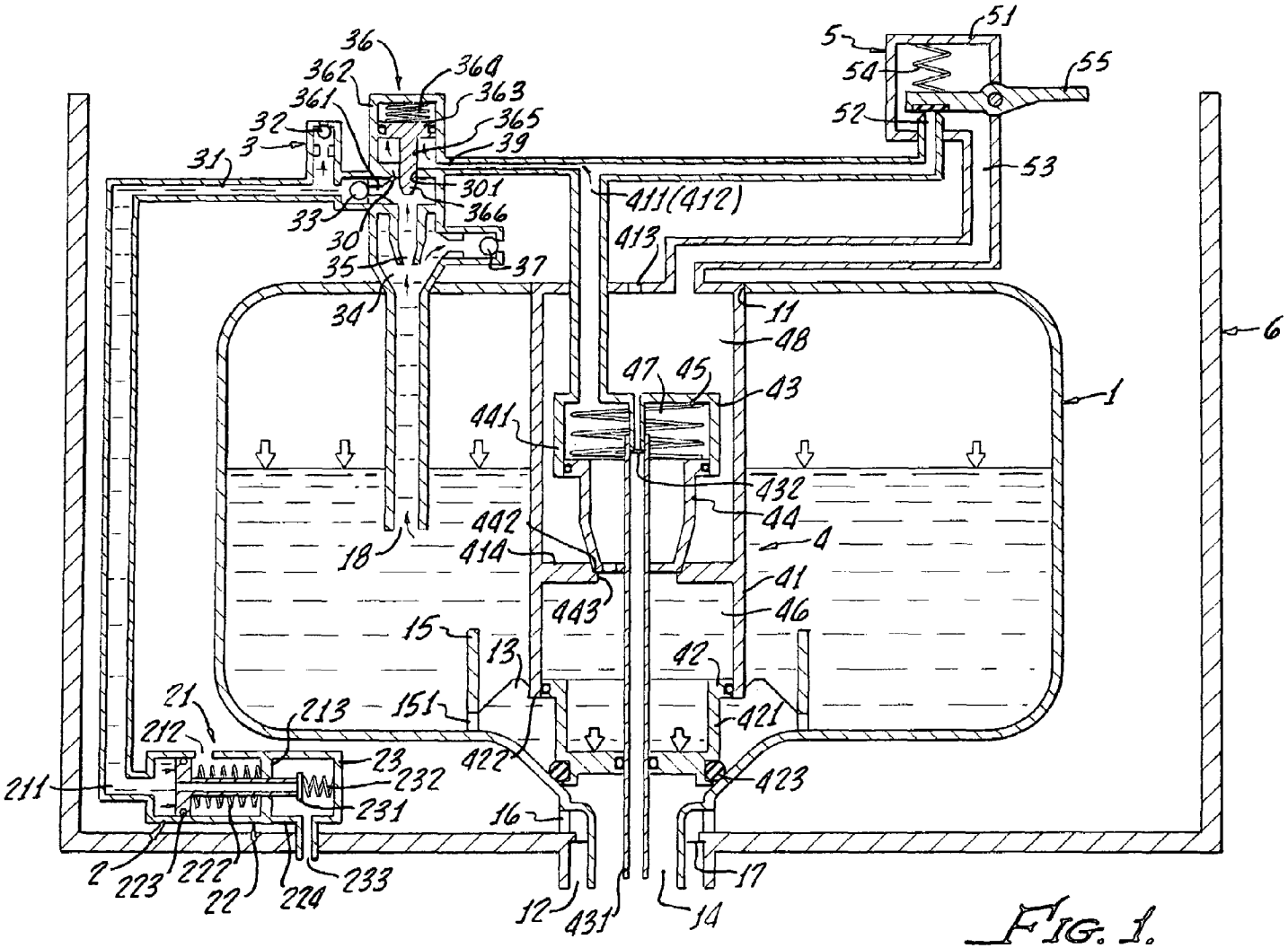
FIG. 1 is a sectional view of the present invention (not in function)

As shown in FIG. 1, the present invention includes a pressure water vessel 1, an infill valve 2, a combination valve 3, a flush valve 4, and an open valve 5. The infill valve 2 is fixed at the bottom of the pressure water vessel 1; the combination valve 3 is fixed on the top of the pressure water vessel 1; the flush valve 4 is fixed through the pressure water vessel 1; and the open valve 5 can be fixed at any position of the ceramic toilet tank 6, namely, the front, side or top of the toilet tank. Below is the detailed description of all these sub assemblies.

The Pressure Water Vessel

The pressure water vessel 1 is a sealed container made of high-strength and high-stability material. An opening 11 is centered on the top of the pressure water vessel 1. The outlet 12 is set under the opening 11 and some external threads are set in the peripheral lower section of the outlet 12 to connect with the inlet of the toilet tank. A locating plate 13 is set at the top of the outlet 12. An outlet 14 is set under the locating plate 13 and inside the upper section of the outlet 12, and its inner diameter is smaller than the diameter of the outlet 12. The cylindrical refill bar 15 is set at the peripheral of the locating plate 13.

The height of the cylindrical refill bar 15 can be adjusted according to different refill rate requirements. This adjustment can be implemented by adjusting the threads or any other ways. At least one refill orifice 151 is set at the bottom of the refill bar 15. In addition, the normal pressure water release hole 16 is set in the sidewall of the upper section of the outlet 12. The ring shaped checked valve 17 is set in the ring area between the outlet 12 below the normal pressure water release hole 16 and the outlet 14. This device can discharge the normal pressure water in the ceramic toilet tank 6. Besides, the inlet 18 is set on the upper section of one side of the pressure water vessel 1.

The pressure water vessel 1 is installed inside a ceramic water tank 6, with external threads on a lower section of the outlet 12 threaded in the inlet of the standard toilet (not shown).

The Infill Valve

The infill valve 2 includes a valve body 21, a valve rod assembly 22, and a valve support 23.

The valve body 21 is a hollow cylinder with an outlet 211 in the front portion and several overflow openings 212 set in the wall panel. A seal gland 213 with a through hole is set in the inner rear portion.

The valve rod assembly 22 is set in the valve body 21, including the valve rod 221, the valve rod spring 222. The valve rod 221 is hollow inside. A seal component 223 is set in the front portion of the valve rod, forming seal with the valve body 21. The posterior segment of the valve rod 221 goes through the through hole of the seal gland 213, forming seal with the seal component 224.

The valve support 23 is fixed at the rear end of the valve body 21. The movable valve support 231 and the spring 232 are set inside the valve support 23. Pushed by the spring 232, the movable valve support 231 pushes against the valve rod 221. The inlet 233 is set in the sidewall of the valve support 23.

The assembled fill valve 2 is fixed onto the ceramic water tank 6 with the inlet 233 connected with the charging duct (not shown in the drawing) of the water supply system, and the outlet 211 is connected by hose with the inlet duct 31 of the combination valve 3 described below.

The infill valve 2 also has the function of pressure stabilizer. Namely, when the pressure in the pressure water vessel 1 is higher than the set value, the inner pressure will be released through the overflow outlet 212 of the infill valve 2 into the ceramic toilet tank 6 until the pressure in front of the infill valve 2 is equal to that of the rear. The structure and the stabilizing process is the same as the technology of the previous application, and will not be described here.

The Combination Valve 3

Inside the combination valve are set an inlet duct 31, an anti-siphon ball valve 32, a check valve 33, an outlet duct 34, a spout 35, a flush control valve 36, an air-in valve 37, and an outlet 39 connecting the flush valve 4 and open valve 5. Among these:

The inlet duct 31 is connected with the infill valve 2.

The anti-siphon ball valve 32 is set on the upper section of the inlet duct 31. When the inlet duct 31 is filled with pressurized water, the anti-siphon valve 32 closes; when the pressure in the water supply system is equal or lower than the atmospheric pressure, the anti-siphon valve 32 opens.

The check valve 33 is set in the channel between the inlet duct 31 and the outlet duct 34. When the pressure in the outlet duct 34 is higher than that in the inlet duct 31, the check valve 33 closes, otherwise, opens.

The bottom of the outlet duct 34 is connected with the inlet 18 of the pressure water vessel 1. Inside the outlet duct 34 is set the spout 35, the lower end of which is set as a conic necking segment.

Above the outlet duct 34 is set the pressure-controlled switch 36, which includes the infill cavity 361, the water pressure cavity 362, the infill piston 363 and the pressure-controlled spring 364. The infill cavity 361 is connected with the check valve 33. A partition 30 with a through hole is set between the infill cavity 361 and the water pressure cavity 362.

The infill piston 363 is set inside the water pressure cavity 362.

The piston rod 365 of the infill piston 363 goes through the through hole 301, and, with the push of the pressure-controlled spring 364, reaches into the spout 35 inside the outlet duct 34. An the seal component 366 set at the ending of the pressure-controlled spring 364 forms seal with the spout 35.

The air-in ball valve 37 is set in the ring chamber between the outlet duct 34 and spout 35. The air-in ball valve 37 and the spout 35 form an air-in device.

The outlet 39 is set on the bottom sidewall of the water pressure cavity 362, and is connected with the inlet 411 of the flush valve 4, and then connecting the inlet 52 of the open valve 52.

In addition, the piston rod 365 and the through hole 362 are a small gap fitting-in. Namely, when the infill piston 363 closes, the pressurized water can goes slowly through the small gap from the infill cavity 361 to the water pressure cavity 362. The fitting-in with small gap has various kinds of structure, but this is not the major point of the present invention, and will not be further described. As shown in the drawing, this small gap fitting-in is to open a small cross-section V groove on the piston rod 365.

The Flush Valve 4

The flush valve is set through inside the pressure water vessel 1, and forms seal with the pressure water vessel 1. The flush valve 4 includes a hollow valve body 41, a big piston 42, an upper cylinder sleeve 43, a small piston 44, and a spring 45. Among these:

Above the valve body 41 are set the inlet 411 and outlet 412 (The drawing is just a diagrammatical sketch, in which the inlet 411 and outlet 412 are shown as one part.); the valve body 41 is placed inside the pressure water vessel 1 through the opening 11 on its top; the bottom of the valve body is fixed on the locating plate 13 in the pressure water vessel 1. The inlet 411 is connected with the outlet 39 of the combination valve 3; the outlet 412 is connected with the inlet 52 of the below described open valve 5. Above the valve body 41 is set a normal pressure orifice which is connected with the outside; inside the middle of the valve body 41 is set a partition 414 with a through hole.

The big piston 42 is set sliding below the partition 414 inside the valve body 41. The seal component 422 seals the space between the partition 414 and the big piston 42, forming the lower cavity 46. A protruding plate 421 with smaller diameter is set at the bottom of the big piston 42. A seal component 423 is set at the bottom end of the protruding plate 421. This seal component 423 can be pushed onto the top of the outlet 14 and seals it.

The upper cylinder sleeve 43 is fixed above the partition 414 in the valve body 41, with an inlet and an outlet, which are connected respectively with the inlet 411, and the outlet 412 of the valve body 41. In the middle of the upper cylinder sleeve 43 is set a water release tube 431, which is directly connected with the outlet 14 of the pressure water vessel 1. A check valve 432 is set inside the water release tube 431.

A small piston 44 is fixed above the partition 414 inside the valve body 41, with the upper part set sliding inside the upper cylinder sleeve 43, forming seal by the seal component 441 with the upper cylinder sleeve 43. A seal component 442 below the small piston 44 can be pushed onto the through hole of the partition 414 of the valve body 41. Besides, at the bottom of the small piston 44 is an opening 443 connecting with the lower cavity 46.

The spring 45 is set between the upper cylinder sleeve 43 and the small piston 44. And, the upper cavity 47 is formed between the upper cylinder sleeve 43 and the small piston 44; the normal pressure cavity 48 is formed above the partition 414 of the valve body 41 and around the upper cylinder sleeve 43 and the small piston 44.

The Open Valve 5

On the body 51 of the open valve 5 is set an inlet 52, which is connected with the outlet 412 of the flush valve 4. On the body 51 is also set a water release hole 53, which is connected through a tube with the normal cavity 48 of the flush valve 4, and then with the water release tube 431 of the flush valve 4. Inside the open valve 5 is set a spring 54 and a handle 55 (or a push button). With the push of the spring 54, a side of the handle 55 can cover and seal the inlet 52 of the body 51.

The open valve 5 can be installed on sidewall of the ceramic tank 6, forming a side-push structure. If the handle 55 is changed into a push button, the open valve 5 can be installed on the top of the ceramic tank 6, forming a top-push open button.

Working Principle

As shown in FIG. 1, the pressurized flush system described in the present invention is in a static state, in which the water level in the pressure water vessel 1 reaches a certain value, and the air in it is compressed. When the pressure in the pressure tank 1 reaches the set value, the infill valve 2 shuts off, and the inlet 18 of the pressure water tank 1 does not fill water any more. Pressure in the pressure-controlled switch 36 of the combination valve 3 and that in the upper cavity 46 and lower cavity 47 of the flush valve 4 come to a balance under normal pressure. The infill piston 363 is at the highest position (open state); the big and small piston 42 and 44 of the flush valve 4 are at the lowest position (closed state); the anti-siphon ball valve 32 and the air-in ball valve 37 inside the combination valve 3 closes with the effect of the water pressure and the check valve 33 is at the open state; and, besides, the open valve 5 is at the closed state, namely, with the push of the spring 54, one side of the handle 55 covers and seals the inlet 52 of the valve body 51.

Figure 2:
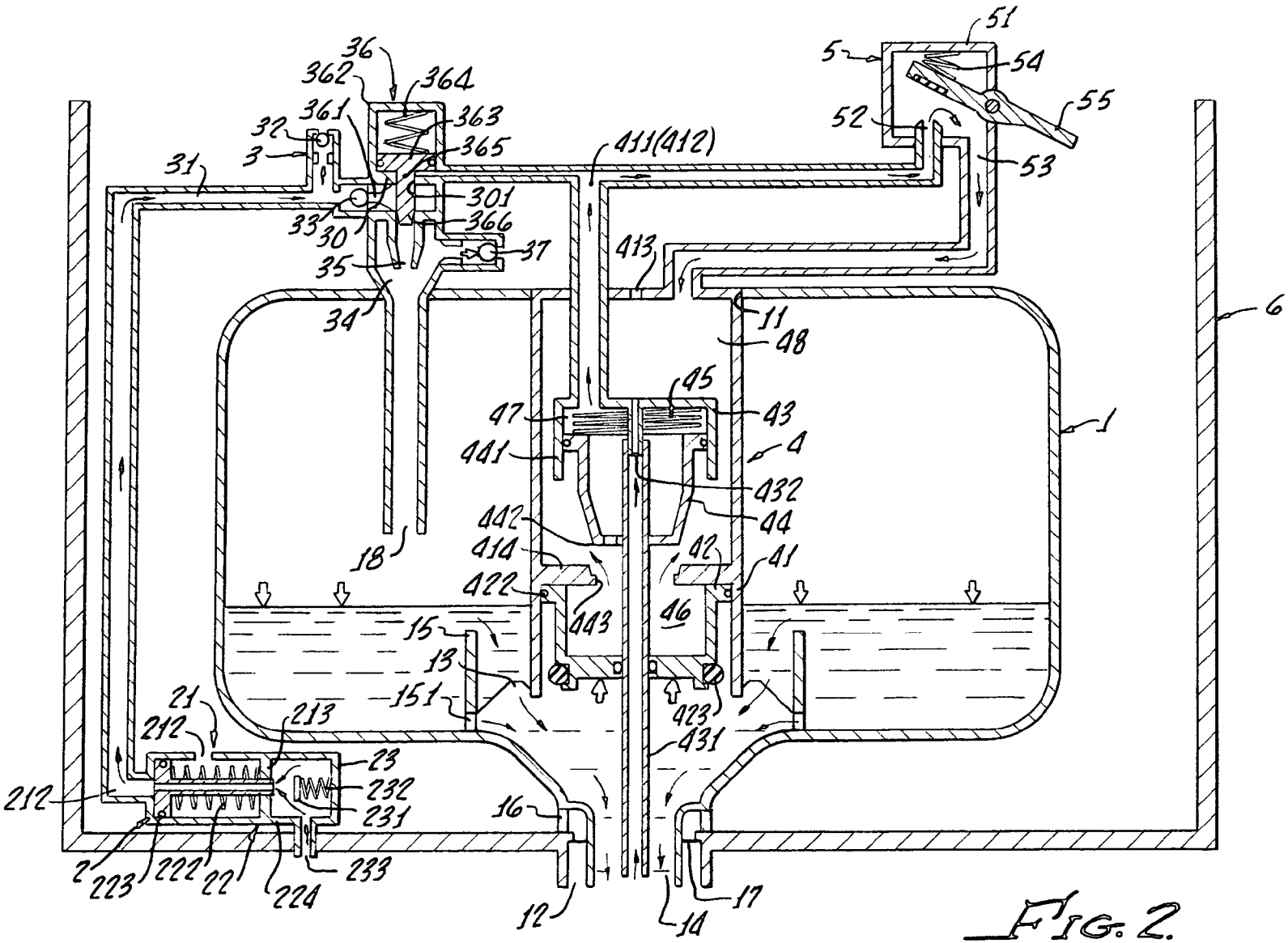
FIG. 2 is a sectional view of the present invention under efficient flushing stage.

As shown in FIG. 2, when to flush the toilet, press the handle 55 of the open valve 5, making the inlet 52 open, and the pressurized water in the upper cavity 47 of the flush valve 4 flows into the open valve 5, and then flows through the outlet 53 of the open valve 5 back into the normal cavity 48 of the flush valve 4, with which the pressure in the upper cavity 47 of the flush valve 4 goes down. Now the pressure in the lower cavity 46 of the flush valve 4 is higher than that in the upper cavity 47, so the pressure in the lower cavity 46 will push the small piston 44 to go up, making the pressurized water in the lower cavity 46 go through the ring channel around the upper cavity 47 into the normal cavity 48.

Then the big piston 42 is effected at the bottom by the pressure in the pressure water vessel 1 and goes up, making the outlet 14 of the pressure water vessel 1 open, and starting to flush the toilet. Meanwhile, as the open valve 5 is connected with the water pressure cavity 362 of the pressure-controlled switch 36 in the combination valve 3, the pressure in the water pressure cavity 362 disappears.

With the effect of the spring 364, the infill piston 363 falls rapidly, and covers and seals the spout 35, closing the inlet 18 of the pressure water vessel 1, and reaches the purpose of not infilling water into the pressure water vessel when flushing. Besides, during the course of flushing the toilet, the resistance pressure makes the pressure in the water release tube 431 of the flush valve 4 increase, pushing the check valve 432 in the water release tube 431 to ascend, and thus preventing water in the toilet flows into the normal pressure cavity. And at the same time, water flowing from the upper cavity 47 of the flush valve 4 and the water pressure cavity 362 of the pressure-controlled switch 36 through the open valve 5, and that from the lower cavity 46 of the flush valve 4 is stored temporarily in the normal pressure cavity 48.

Figure 3:
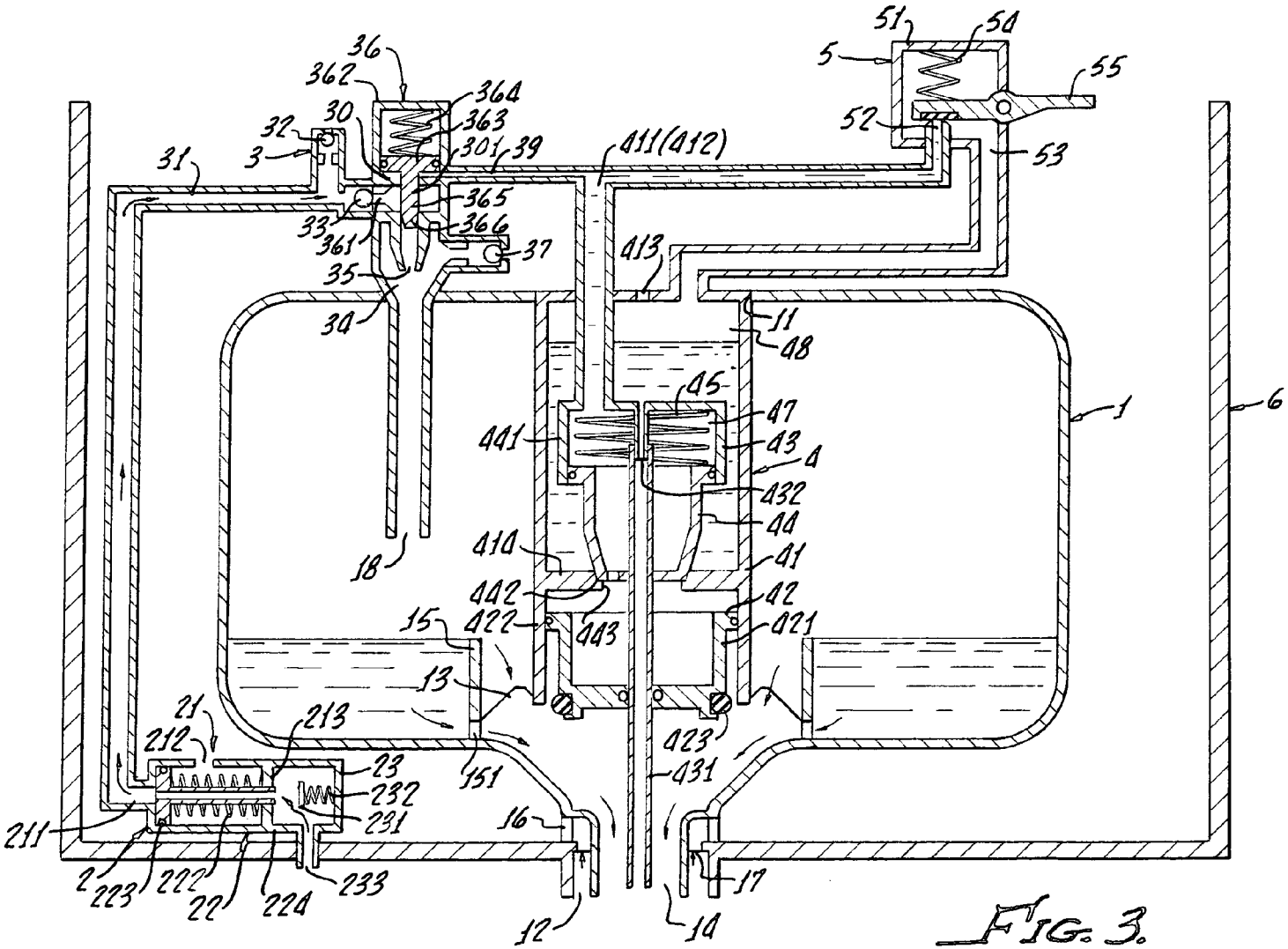
FIG. 3 is a sectional view of the present invention under a posterior stage of flushing.

As shown in FIG. 3, when the water level in the pressure water vessel 1 goes down to the top of the refill bar 15, the big-area outlet 14 is exposed in the compressed air in the pressure water vessel 1. The compressed air flushes rapidly out of the outlet 14 of the pressure water vessel 1, and pushes the water flow in the toilet channel, which reaches the performance of a high-speed flush of the posterior water flow, and making the posterior flush still as strong.

Figure 4:
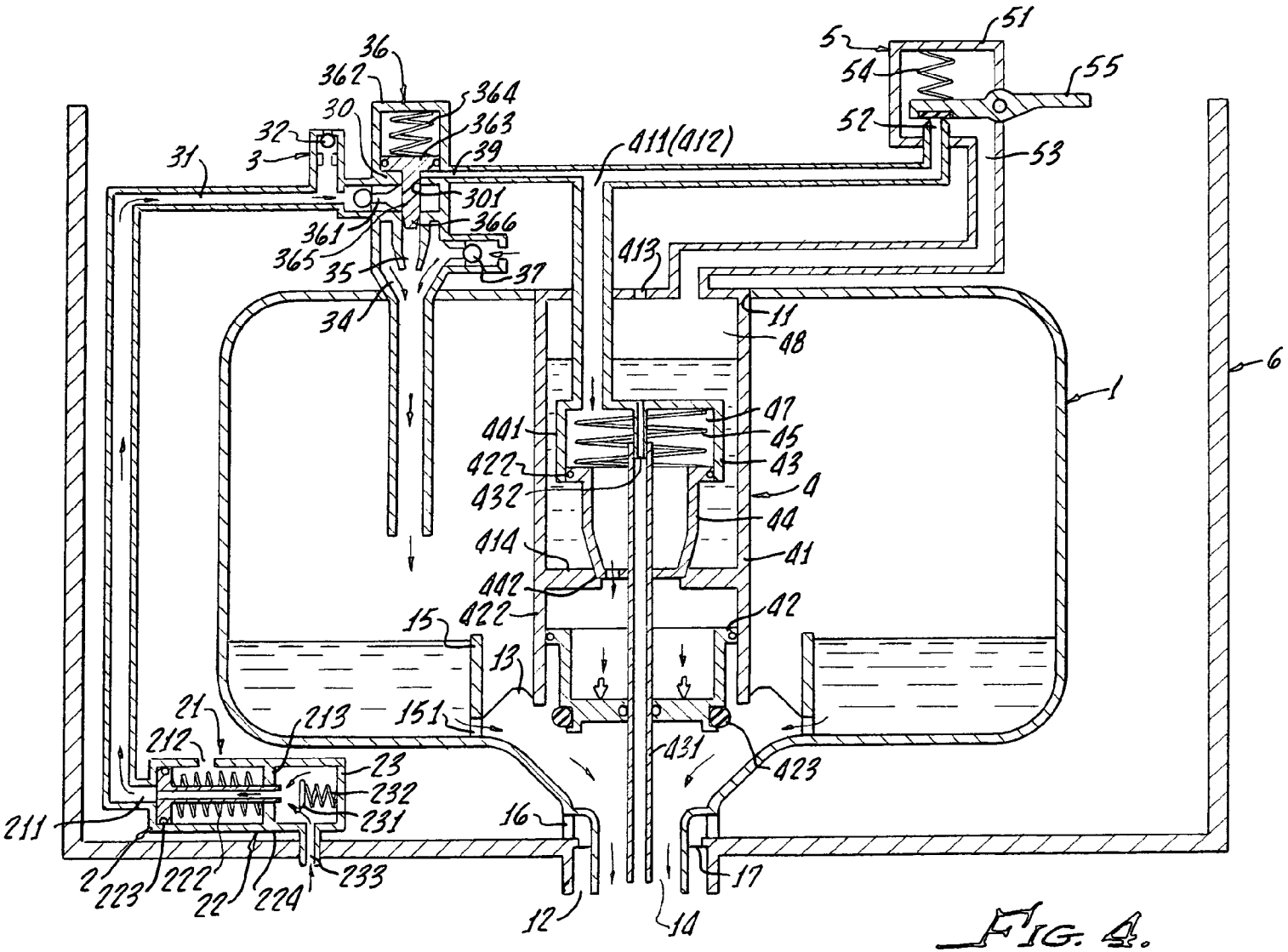
FIG. 4 is a sectional view of the present invention in a refilling stage.

As shown in FIG. 4, as now the pressure water vessel 1 is under normal pressure, with the work of gravity the water below the refill bar 15 flows slowly into the toilet, forming water seal, and the whole process from flushing to refill is completed. Now as the pressure in the toilet channel is restored into normal pressure, the check valve 432 inside the water release tube 431 of the flush valve 4 falls down, the water stored in the normal pressure cavity during flushing flows through the water release tube 431 into the toilet.

Figure 5:
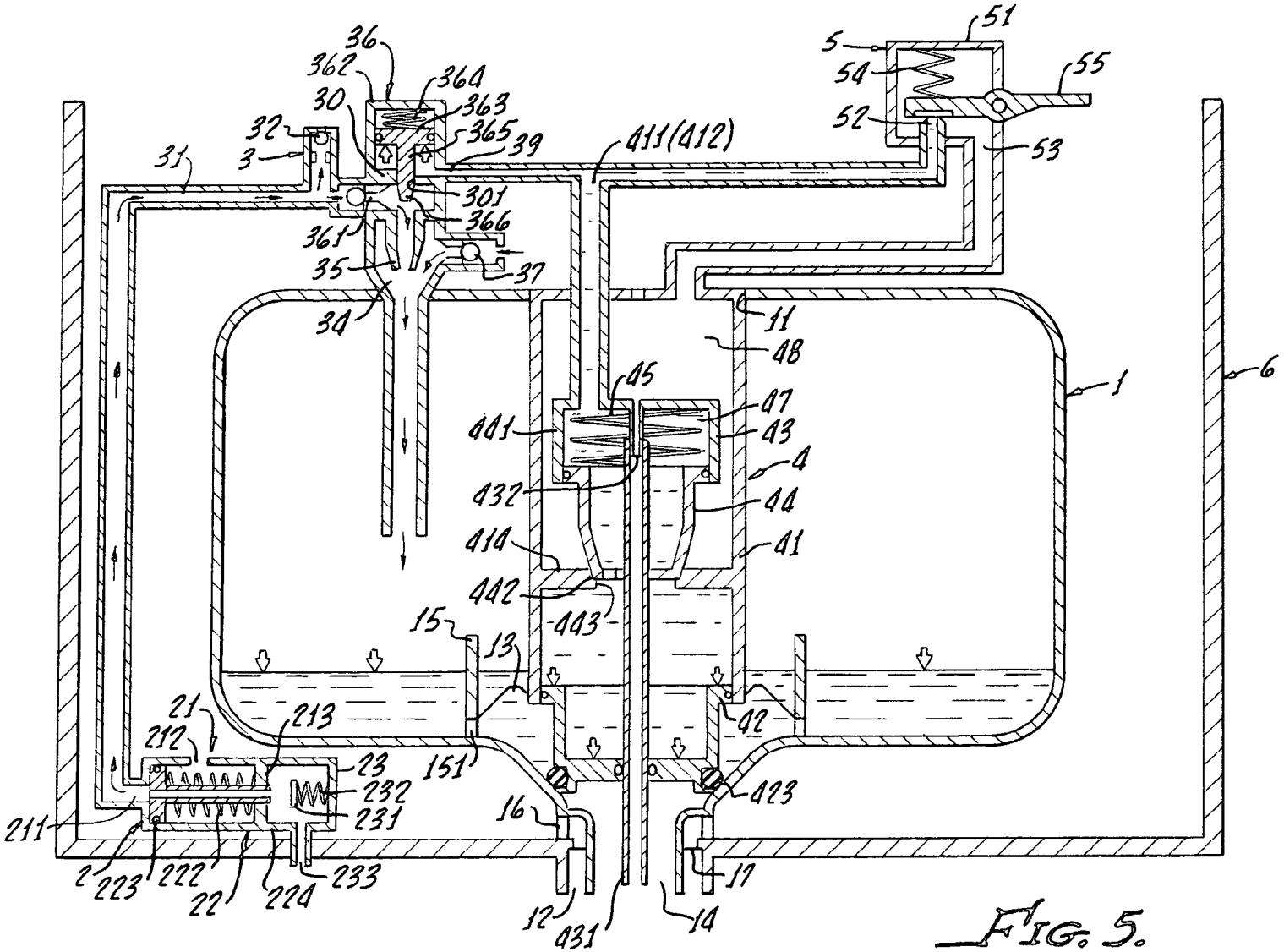
FIG. 5 is a sectional view of the present invention in a refilling stage.

As shown in FIG. 5, during the process of flushing and refill, as the open valve 5 has closed, the pressure in the pressure water vessel 1 disappears, and the valve rod 221 of the infill valve 2 opens itself by the effect of the spring 222.

The pressurized water from the water supply system flows through the hollow valve rod 221 into the pressure-controlled switch 36. A small portion of this pressurized water flows through the V shaped groove in the piston rod 365 of the infill piston 363 into the water pressure cavity 362, and then into the upper cavity 47 of the flush valve 4, and next through the opening 443 in the bottom of the small piston 44 into the lower cavity 46, and pushes the big piston 42 to close.

As the cross section of the opening 443 in the bottom of small piston 44 is bigger than that the V shaped groove on the piston rod 365 of the infill piston 363, the water pressure in the water pressure cavity 362 of the combination valve 3 cannot increase until the small piston 42 and the big piston 44 of the flush valve 4 close. And then this water pressure overcomes the action force of the spring 364, making the infill piston 363 ascend, and opening the inlet 18 of the pressure water vessel 1. Now the major portion of the pressurized water from the water supply system flows through the spout 35 into the pressure water vessel 1.

During the initial process of the infilling water, as the pressure water vessel 1 is under a normal or law pressure state, the pressure difference between the back and front of the spout 35 is comparatively big, and as the front of the spout 35 is set as a conic necking segment, the speed of the water flowing through the spout 35 is very high.

The high-speed water column makes the ring chamber around the conic necking segment become vacuum, namely produce a Venturi effect. The atmospheric pressure pushes the air-in ball valve 37 open; air is carried into the pressure water vessel 1.

With the water level in the pressure water vessel 1 going up, the pressure goes up as well, and the Venturi effect disappears; the air-in ball valve 37 closes with the effect of the pressure in the pressure water vessel 1.

Now the pressurized water from the water supply system continues flowing into the pressure water vessel 1 until the pressure in the pressure water vessel reaches a certain value, and then the infill valve 2 closes. The water infill process is completed, and the whole flush system restores to the static state.

Although there has been hereinabove described a specific pressurized flush system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A pressurized flush system comprising:

a pressure water vessel, having an inlet and an outlet;

an infill valve;

an open valve; and a flush valve disposed within said pressure water vessel and in fluid communication with said infill valve and said open valve, said flush valve comprising:

a hollow valve body;

cooperating pistons controlling water discharge from the water vessel outlet, said cooperating pistons being disposed within said hollow valve body; and a partition disposed within the valve body, said partition having a hole therethrough and said cooperating piston includes a big piston disposed below said partition and a small piston disposed above said partition within an upper cylinder sleeve, said small piston having a bottom engaging the partition hole.

2. The system according to claim 1 further comprising a water release tube disposed inside the flush valve and located in a middle of the upper cylinder sleeve and extending to the water vessel outlet, a check valve being disposed inside the water release tube.

3. The system according to claim 1 wherein said big piston, small piston, upper cylinder sleeve, and partition divide the valve body into a lower cavity, an upper cavity and a normal pressure cavity.

4. The system according to claim 3 further comprises a normal pressure opening disposed in said normal pressure cavity and said small piston include an opening in the bottom thereof communicating with said upper cavity.

5. The system according to claim 4 wherein said open valve includes an open valve body with an inlet connected with an outlet of the flush valve, said open valve body includes a water release hole connected to the normal pressure cavity, and said open valve includes a spring loaded handle having a side covering and sealing the open valve body inlet.

6. The system according to claim 1 further comprising a combination valve disposed between the infill valve and the water vessel inlet, said combination valve including a pressure-controlled valve disposed in a manner shutting of the vessel inlet when the water vessel is discharging water and an air-in device disposed in a manner filling air into the water vessel when water is filled into the water vessel.

7. The system according to claim 6 wherein said pressure-controlled valve includes an infill cavity, a water pressure cavity, an infill piston and a pressure-controlled spring, the infill cavity being connected respectively with the inlet duct and the outlet duct of the combination valve; the water pressure cavity being connected with the outlet of the combination valve.

8. The system according to claim 7 further comprises a through hole partition disposed between the infill cavity and the water pressure cavity and the infill piston is disposed inside the water pressure cavity on which is set a piston rod, which goes through the partition through hole and reaches into an outlet duct with the push of the pressure-controlled spring with and end forming a seal with the outlet duct.

9. The system according to claim 8 wherein a spout is disposed inside the outlet duct of the combination valve, the spout having a necked bottom and an air-in ball valve is disposed in a ring shaped cavity between the outlet duct and the spout, the ball valve forming an air-in device with the spout.

10. The system according to claim 6 further comprising an anti-siphon ball valve disposed in a combination valve inlet duct, the anti-siphon ball valve opening when the pressure in a water supply line is equal or lower than atmospheric pressure.

11. The system according to claim 10 further comprising a check ball valve disposed in a channel between the connecting valve inlet duct and a combination valve outlet duct, the check ball valve shutting off when pressure in the combination valve outlet duct is higher than pressure in the combination valve inlet duct.

12. A pressurized flush system comprising:

a pressure water vessel, having an inlet and an outlet;

an infill valve;

an open valve;

a flush valve disposed within said pressure water vessel and in fluid communication with said infill valve and said open valve, said flush valve comprising:

a hollow valve body;

cooperating pistons controlling water discharge from the water vessel outlet, said cooperating pistons being disposed within said hollow valve body; and an outer flank surrounding the vessel outlet and defining an annulus outlet therebetween, the flank including a normal pressure water release hole and a ring shaped check valve is disposed in said annulus outlet below the normal pressure water release hole.

* * * * *